US007165536B2

(12) United States Patent
Kirk et al.

(10) Patent No.: US 7,165,536 B2
(45) Date of Patent: Jan. 23, 2007

(54) EVAPORATIVE EMISSIONS CONTROL SYSTEM FOR SMALL INTERNAL COMBUSTION ENGINES

(75) Inventors: J. David Kirk, Fond Du Lac, WI (US); Ronald J. Donahue, Fond Du Lac, WI (US); Todd L. Carpenter, Gregory, MI (US)

(73) Assignee: Tecumseh Products Company, Tecumseh, MI (US)

( * ) Notice: Subject to any disclaimer, the term of this patent is extended or adjusted under 35 U.S.C. 154(b) by 51 days.

(21) Appl. No.: 11/062,955

(22) Filed: Feb. 22, 2005

(65) Prior Publication Data

US 2005/0274364 A1 Dec. 15, 2005

Related U.S. Application Data

(60) Provisional application No. 60/579,530, filed on Jun. 14, 2004.

(51) Int. Cl.
*F02M 33/02* (2006.01)
*F02M 33/08* (2006.01)

(52) U.S. Cl. ..... 123/519; 261/41.5

(58) Field of Classification Search ..... 123/519, 123/520, 518, 516, 527; 261/41.5, 44, 69.2, 261/63, DIG. 18
See application file for complete search history.

(56) References Cited

U.S. PATENT DOCUMENTS

| | | | | |
|---|---|---|---|---|
| 1,473,303 A | | 11/1923 | Lightford | |
| 2,009,109 A | | 7/1935 | Hunt | 261/67 |
| 2,131,811 A | | 10/1938 | Kittredge | 123/198 |
| 2,144,017 A | | 1/1939 | Gistucci | 261/69 |
| 2,316,327 A | | 4/1943 | Garretson | 261/69 |
| 2,361,761 A | * | 10/1944 | Gerson | 261/160 |
| 2,445,097 A | | 7/1948 | Wirth | 261/69 |
| 2,454,974 A | | 11/1948 | Mennesson | 261/36 |
| 2,680,605 A | | 6/1954 | Bracke | 261/63 |
| 2,774,582 A | | 12/1956 | Bracke | 261/41 |
| 2,846,203 A | | 8/1958 | Voss et al. | 261/36 |
| 3,174,730 A | | 3/1965 | Barr | 261/65 |
| 3,201,096 A | | 8/1965 | Barr | 261/41 |

(Continued)

*Primary Examiner*—Mahmoud Gimie
(74) *Attorney, Agent, or Firm*—Baker & Daniels LLP

(57) ABSTRACT

An evaporative emissions control system for small internal combustion engines. The system generally includes a charcoal canister and a carburetor with a fuel circuit shutoff valve. The charcoal canister is in fluid communication with the air space above the liquid fuel within the engine fuel tank, and optionally, with the air space above the liquid fuel within the fuel bowl of a fuel bowl-type carburetor. The charcoal canister contains charcoal media which absorbs fuel vapors when the engine is not running. During running of the engine, vacuum within the carburetor induces a flow of atmospheric air through the charcoal canister to purge the collected fuel vapors from the charcoal media, and the fuel vapors pass into the engine for consumption. The carburetor of the engine, which may be either a fuel bowl-type carburetor or a diaphragm carburetor, includes a fuel circuit shutoff valve controlled either by a vacuum signal produced within the engine or by a user-actuated mechanical linkage. The fuel circuit shutoff valve closes the fuel circuit of the carburetor upon engine shutdown to prevent escape of fuel vapors from the carburetor to the atmosphere. In another embodiment, a weir-type carburetor is disclosed which contains a minimal amount of fuel when the engine is not running to reduce or eliminate evaporative emissions.

20 Claims, 9 Drawing Sheets

U.S. PATENT DOCUMENTS 3,275,307 A 9/1966 Robechaud ..... 261/36
3,352,294 A * 11/1967 Skarstrom et al. ..... 123/519
3,618,581 A 11/1971 Simonet ..... 123/198
3,630,497 A 12/1971 Bascle ..... 261/50
3,635,201 A 1/1972 High ..... 123/130
3,695,590 A 10/1972 Nishihara ..... 261/36
3,742,928 A 7/1973 Albertson ..... 123/198
3,752,134 A * 8/1973 Hollis, Jr. ..... 123/520
3,779,529 A 12/1973 Kimura ..... 261/35
3,913,545 A * 10/1975 Haase et al. ..... 123/520
3,973,550 A 8/1976 Sparks et al. ..... 123/198
4,058,105 A 11/1977 Schellin et al. ..... 123/198
4,106,471 A 8/1978 Nakajima et al. ..... 123/198
4,111,176 A 9/1978 Fenton et al. ..... 123/198
4,122,819 A 10/1978 Moshofsky et al. ..... 123/198
4,168,289 A 9/1979 Saunion ..... 261/36
RE30,844 E 1/1982 Yagi et al. ..... 123/198
4,353,847 A 10/1982 Sato et al. ..... 261/36
4,366,790 A 1/1983 DeBoynton ..... 123/325
4,510,739 A 4/1985 Dluhosch ..... 56/17.5
4,513,706 A 4/1985 Atzet ..... 123/198
4,577,597 A 3/1986 Tomita ..... 123/73
4,770,822 A 9/1988 Sejimo ..... 261/35
4,781,165 A * 11/1988 Rawlings ..... 123/555
4,877,560 A 10/1989 Kenny et al. ..... 261/35
4,893,594 A 1/1990 Kobayashi ..... 123/187.5
5,003,943 A 4/1991 Lafferty, Sr. ..... 123/198
5,050,548 A 9/1991 Minegishi ..... 123/198
5,058,544 A 10/1991 Guntly et al. ..... 123/187.5
5,092,295 A 3/1992 Kobayashi ..... 123/198
5,250,233 A 10/1993 Swanson ..... 261/34.2
5,301,644 A 4/1994 Olmr ..... 123/198
5,357,935 A 10/1994 Oxley et al. ..... 123/527
5,411,680 A 5/1995 McCarthy et al. ..... 261/35
5,711,901 A 1/1998 Berg et al. ..... 261/35
5,720,250 A 2/1998 Greppmair et al. ..... 123/198
5,730,098 A 3/1998 Sasaki et al. ..... 123/198
5,810,033 A 9/1998 Nakayama et al. ..... 137/574
5,843,345 A 12/1998 Guntly ..... 261/34.2
5,894,833 A 4/1999 Kikuchi et al. ..... 123/516
6,082,323 A 7/2000 Winberg ..... 123/198
6,135,429 A 10/2000 Woody ..... 261/35
6,213,083 B1 4/2001 Winberg ..... 123/198
6,267,102 B1 7/2001 Pattullo et al. ..... 123/437
6,394,424 B2 5/2002 Pattullo et al. ..... 261/35
6,615,792 B1 9/2003 Grifka et al. ..... 123/198
6,640,770 B2 11/2003 Woody ..... 123/198
6,644,631 B2 11/2003 Suzuki ..... 261/35
6,715,737 B2 4/2004 Galka et al. ..... 261/35
6,959,696 B2 11/2005 Shears et al. ..... 123/516
2003/0047818 A1 3/2003 Nagata ..... 261/35
2004/0123846 A1* 7/2004 Rado et al. ..... 123/525
2005/0178368 A1* 8/2005 Donahue et al. ..... 123/520
2006/0042604 A1 3/2006 Haskew et al.
2006/0096583 A1 5/2006 Shears et al.
2006/0096584 A1 5/2006 Shears et al.

* cited by examiner

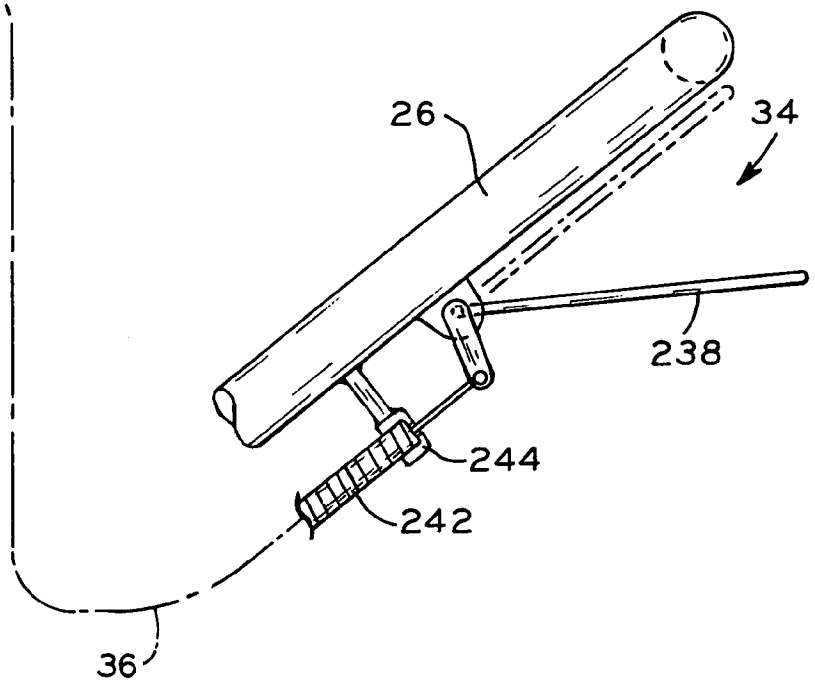
FIG. 5A
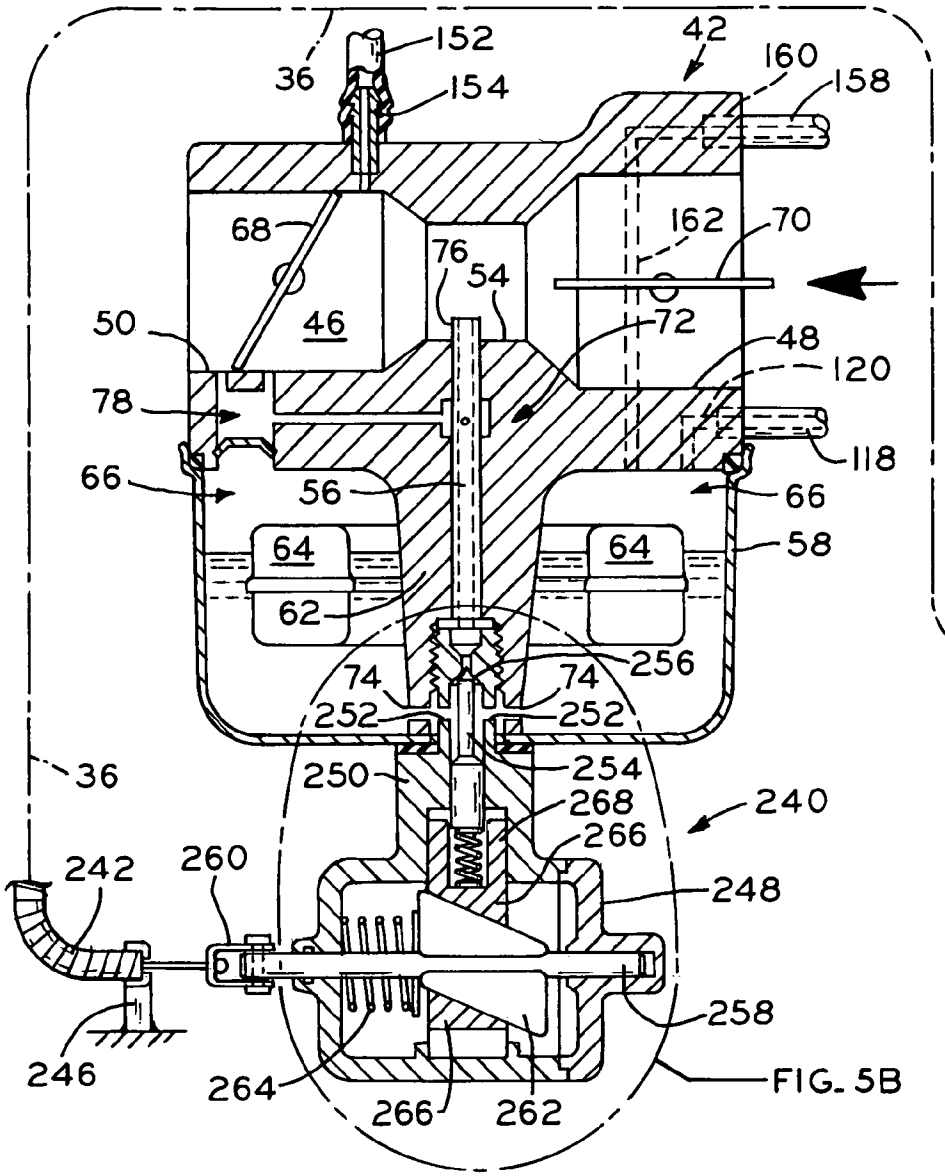

EVAPORATIVE EMISSIONS CONTROL SYSTEM FOR SMALL INTERNAL COMBUSTION ENGINES

CROSS-REFERENCE TO RELATED APPLICATIONS

This application claims the benefit under Title 35, U.S.C. §119(e) of U.S. Provisional Patent Application Ser. No. 60/579,530, entitled EVAPORATIVE EMISSIONS CONTROL SYSTEM FOR SMALL INTERNAL COMBUSTION ENGINES, filed on Jun. 14, 2004.

BACKGROUND OF THE INVENTION

1. Field of the Invention

The present invention relates to small internal combustion engines of the type used with lawnmowers, lawn tractors, and other utility implements. In particular, the present invention relates to an emissions control system for such engines.

2. Description of the Related Art

Small internal combustion engines of the type used with lawnmowers, lawn tractors, and other small utility implements typically include an intake system including a carburetor attached to the engine which mixes liquid fuel with atmospheric air to form a fuel/air mixture which is drawn into the engine for combustion.

One known type of carburetor includes a fuel bowl containing a supply of liquid fuel which is drawn into the throat of the carburetor to mix with atmospheric air during running of the engine. A float within the fuel bowl actuates a valve which meters liquid fuel into the fuel bowl from a fuel tank. In another known type of carburetor, a diaphragm pump attached to the crankcase of the engine is actuated by pressure pulses within the engine to pump fuel from a fuel tank into a fuel chamber within the carburetor, from which the fuel is drawn into the throat of the carburetor to mix with atmospheric air.

In each of the foregoing arrangements, the carburetor is attached via a fuel line to a fuel tank, which stores a quantity of liquid fuel. The fuel tank includes a filler neck through which fuel may be filled into the fuel tank, and a fuel tank cap is attached to the filler neck to close the fuel tank. The fuel tank cap usually includes a venting structure for allowing any pressurized fuel vapors within the fuel tank to vent through the fuel tank cap to the atmosphere. Also, the venting structure allows atmospheric air to enter the fuel tank from the atmosphere as necessary to occupy the expanding volume within the fuel tank which is created as the fuel within the fuel tank is consumed by the engine.

A problem with the existing intake and fuel supply systems of such small internal combustion engines is that fuel vapors may escape from the fuel supply systems to the atmosphere, such as from the carburetor or from the fuel tank. For example, in a float bowl type of carburetor, fuel vapors may escape to the atmosphere via the internal venting structure of the carburetor which connects the air space of the fuel bowl with the carburetor throat, or through the fuel circuit of the carburetor. Also, fuel vapors in the fuel tank may escape to the atmosphere through the venting structure in the fuel tank cap.

What is needed is a fuel supply system for small internal combustion engines which prevents the escape of fuel vapors to the atmosphere, thereby controlling and/or substantially eliminating fuel vapor emissions from such engines.

SUMMARY OF THE INVENTION

The present invention provides an evaporative emissions control system for small internal combustion engines. The system generally includes a charcoal canister and a carburetor with a fuel circuit shutoff valve. The charcoal canister is in fluid communication with the air space above the liquid fuel within the engine fuel tank, and optionally, with the air space above the liquid fuel within the fuel bowl of a fuel bowl-type carburetor. The charcoal canister contains charcoal media which absorbs fuel vapors when the engine is not running. During running of the engine, vacuum within the carburetor induces a flow of atmospheric air through the charcoal canister to purge the collected fuel vapors from the charcoal media, and the fuel vapors pass into the engine for consumption. The carburetor may be either a fuel bowl-type carburetor or a diaphragm carburetor, and includes a fuel circuit shutoff valve controlled either by a vacuum signal produced within the engine or by a user-actuated mechanical linkage. The fuel circuit shutoff valve closes the fuel circuit of the carburetor upon engine shutdown to prevent escape of fuel vapors from the carburetor to the atmosphere.

The charcoal canister may be integrally formed with the body of the fuel tank, for example, and includes a long dimension having opposite ends connected to a vacuum source within the carburetor and to a source of atmospheric air, respectively, and a minor dimension in communication with the headspace of the fuel bowl of the carburetor and with the interior of the fuel tank. When the engine is not running, fuel vapors from the fuel bowl of the carburetor and from the fuel tank migrate to the charcoal canister, and are trapped within the charcoal media, saturating the charcoal media from the central portion of the charcoal canister outwardly along the long dimension of the charcoal canister to most effectively utilize the volume of charcoal media for trapping fuel vapors. When the engine is running, a flow of purging atmospheric air is induced through the charcoal canister along its long dimension to ensure effective purging of the collected fuel vapors from the charcoal canister.

The evaporative emissions control systems also include either a fuel bowl-type carburetor or a diaphragm carburetor. In one embodiment, a fuel bowl-type carburetor includes a body having a throat passage, a fuel bowl containing liquid fuel, and a fuel circuit fluidly communicating the fuel bowl with the throat passage. A fuel circuit shutoff valve includes a diaphragm and valve member together movable responsive to vacuum within a vacuum chamber of the carburetor between a first position corresponding to engine shutdown, in which the vacuum chamber is at atmospheric pressure and the valve member blocks fuel flow from the fuel chamber to the fuel circuit, and a second position corresponding to running of the engine, in which the vacuum chamber is at sub-atmospheric pressure and the valve member allows fuel flow from the fuel chamber to the fuel circuit. In this manner, the fuel circuit shutoff valve is automatically operable upon engine shutdown to seal the fuel bowl and prevent escape of fuel vapors from the fuel bowl to the atmosphere.

In another embodiment, a diaphragm carburetor includes first and second diaphragms, and a fuel chamber defined between the first diaphragm and the carburetor body which includes liquid fuel. A fuel circuit fluidly communicates the fuel chamber with the throat passage of the carburetor, and a vacuum chamber is defined within the carburetor body between the first and second diaphragms, the vacuum chamber in airflow communication with the throat passage. A fuel circuit shutoff valve includes a valve member connecting the first and second diaphragms. The first and second diaphragms are movable together with the valve member responsive to vacuum within the vacuum chamber between a first position corresponding to engine shutdown, in which the vacuum chamber is at atmospheric pressure and the valve member closes the fuel circuit, and a second position corresponding to running of the engine, in which the vacuum chamber is at sub-atmospheric pressure and the valve member allows fuel flow from the fuel chamber to the fuel circuit. Thus, the fuel circuit shutoff valve is operable upon engine shutdown to seal the fuel chamber of the diaphragm carburetor and prevent the escape of fuel vapors therefrom to the atmosphere.

In a further embodiment, rather than including a vacuum-operated fuel circuit shutoff valve, the fuel bowl-type carburetor may include fuel circuit shutoff valve which is automatically actuated via mechanical linkage by the bail assembly of the implement with which the engine is used. In use, actuation of the bail assembly by the operator automatically opens the fuel circuit shutoff valve before the engine is started to allow fuel flow into the fuel circuit of the carburetor. When the bail assembly is released by the operator upon engine shutdown, the fuel circuit shutoff valve of the carburetors automatically closes to prevent escape of fuel vapors from the carburetor to the atmosphere through the fuel circuit of the carburetor.

In a still further embodiment, the evaporative emissions control system includes a weir-type carburetor which, rather than including a fuel bowl, includes a fuel chamber having a weir into which fuel is pumped by a fuel pump during running of the engine. Fuel is drawn from the weir through the fuel circuit into the throat of the carburetor during operation of the engine, wherein the fuel pump supplies more fuel to the weir than is consumed by the engine, and excess fuel overflows the weir and returns through a return line to the fuel tank. Additionally, the weir includes a bleed port to allow most of the fuel in the weir to slowly drain upon engine shutdown, while maintaining a sufficient fuel level in the weir to allow for hot engine re-starts without choking or priming. Advantageously, after engine shutdown, the amount of fuel remaining in the weir is minimized, which in turn minimizes or eliminates evaporative fuel emissions through the carburetor fuel circuit.

In one form thereof, the present invention provides an internal combustion engine, including a fuel tank containing liquid fuel; a fuel vapor control device including a housing in fluid communication with an upper portion of the fuel tank, the housing containing fuel vapor absorbent media, whereby fuel vapors from the liquid fuel within the fuel tank are trapped by the absorbent media; and a carburetor, including a carburetor body having an air intake passage; a fuel chamber containing liquid fuel, the fuel chamber in fluid communication with the fuel tank; a fuel circuit fluidly communicating the fuel chamber with the air intake passage, and a fuel circuit shutoff valve associated with the fuel circuit, including a valve member movable between a first, closed position in which fuel flow from the fuel chamber to the air intake passage is substantially prevented and a second, open position in which fuel flow from the fuel chamber to the air intake passage is allowed.

In another form thereof, the present invention provides an internal combustion engine, including a fuel tank containing liquid fuel; and a carburetor, including a carburetor body having an air intake passage therethrough; a fuel bowl disposed beneath the carburetor body, the fuel bowl in fluid communication with the fuel tank; a fuel circuit fluidly communicating the fuel bowl with the air intake passage, and a vacuum-actuated fuel circuit shutoff valve including a vacuum chamber in fluid communication with the air intake passage, a diaphragm disposed within the vacuum chamber and connected to a valve member, the diaphragm and valve member together movable between a first, closed position corresponding to atmospheric pressure in the vacuum chamber in which fuel flow from the fuel chamber to the air intake passage is substantially prevented and a second, open position corresponding to sub-atmospheric pressure in the vacuum chamber in which fuel flow from the fuel chamber to the air intake passage is allowed.

In another form thereof, the present invention provides an internal combustion engine, including a fuel tank containing liquid fuel; and a carburetor, including a carburetor body having an air intake passage therethrough; first and second diaphragms; a fuel chamber defined between the first diaphragm and the carburetor body, the fuel chamber in fluid communication with the fuel tank; a fuel circuit fluidly communicating the fuel chamber with the air intake passage; a vacuum chamber defined within the carburetor body between the first and second diaphragms, the vacuum chamber in airflow communication with the air intake passage; and a fuel circuit shutoff valve including a valve member connecting the first and second diaphragms, the first and second diaphragms together movable with the valve member responsive to vacuum within the vacuum chamber between a first position corresponding to atmospheric pressure in the vacuum chamber, in which the valve member closes the fuel circuit, and a second position corresponding to sub-atmospheric pressure within the vacuum chamber, in which the valve member opens the fuel circuit.

In a further form thereof, the present invention provides an internal combustion engine, including a fuel tank containing liquid fuel; a fuel vapor control device including a housing in fluid communication with an upper portion of the fuel tank, the housing containing fuel vapor absorbent media, whereby fuel vapors from the liquid fuel within the fuel tank are trapped by the absorbent media; and a carburetor, including a carburetor body having an air intake passage; a fuel chamber having a fuel inlet and a fuel outlet each in fluid communication with the fuel tank; a fuel circuit fluidly communicating the fuel chamber with the air intake passage, and a fuel pump driven from the engine, the fuel pump circulating fuel from the fuel tank to the chamber and thence from the chamber to the fuel tank.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein:

FIG. 5A is a sectional view of a fuel bowl-type carburetor which may be used with the evaporative emissions control system of FIG. 2A, the carburetor including a mechanically-actuated fuel circuit shutoff valve shown in a first or closed position;

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
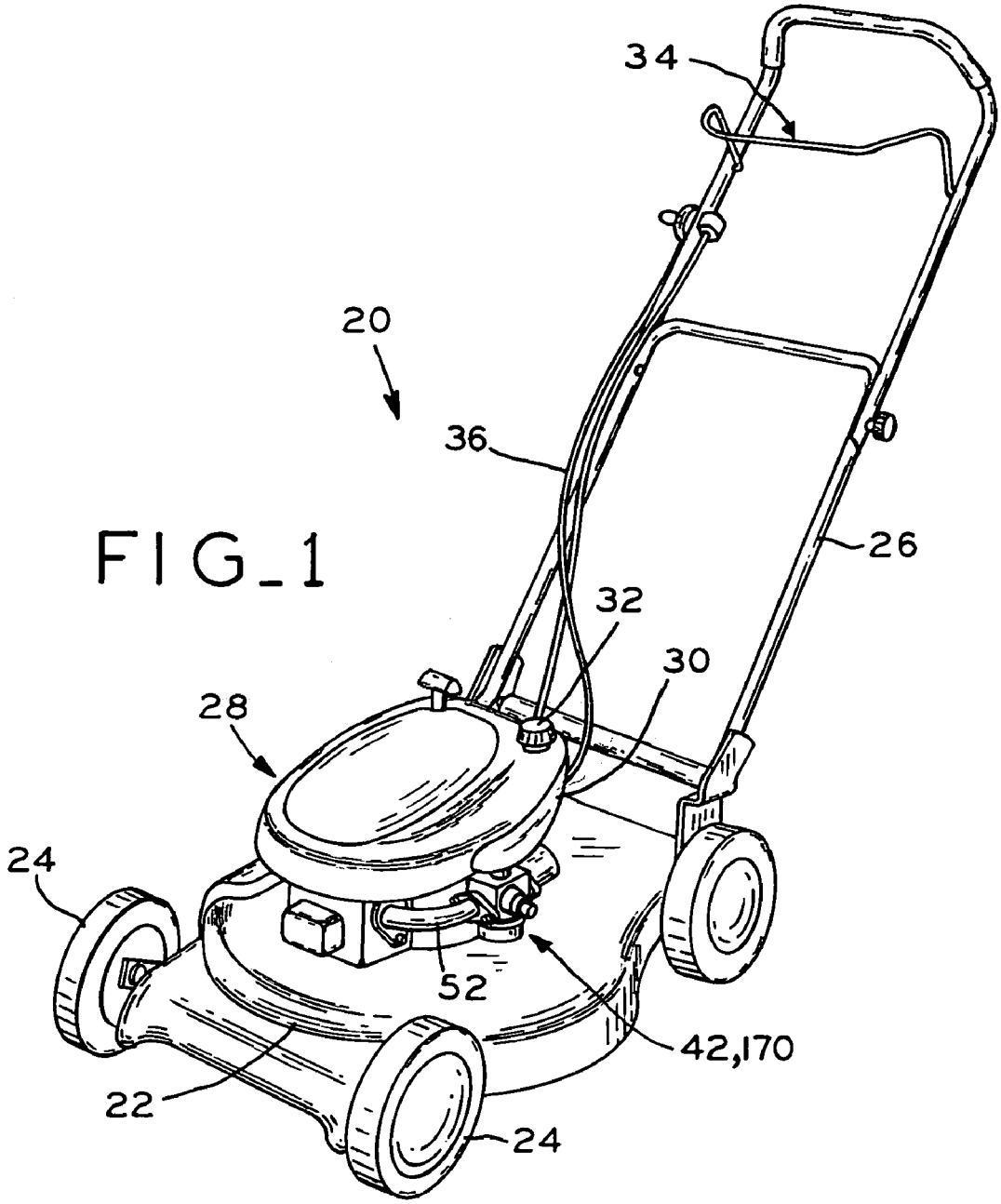
FIG. 1 is a perspective view of a lawnmower including an internal combustion engine having an evaporative emissions control system in accordance with the present invention.

Referring first to FIG. 1, lawnmower 20 is shown as an example of an implement with which a small internal combustion engine may be used, the engine including an evaporative emissions control system in accordance with the present invention. Lawnmower 20 generally includes deck 22 having wheels 24, and a user-operable handle 26 extending upwardly from deck 22. A small internal combustion engine 28 is mounted to deck 24. Engine 28 is shown herein as a vertical crankshaft engine which drives a cutting blade (not shown) disposed beneath deck 22. However, the evaporative emissions control systems of the present invention are equally applicable to horizontal crankshaft engines, as well as engines having one, two, or multiple cylinders of the type commonly used with a variety of different types of implements, including lawnmowers, lawn and garden tractors, snow throwers, compressors, generators, and the like.

Figure 6:
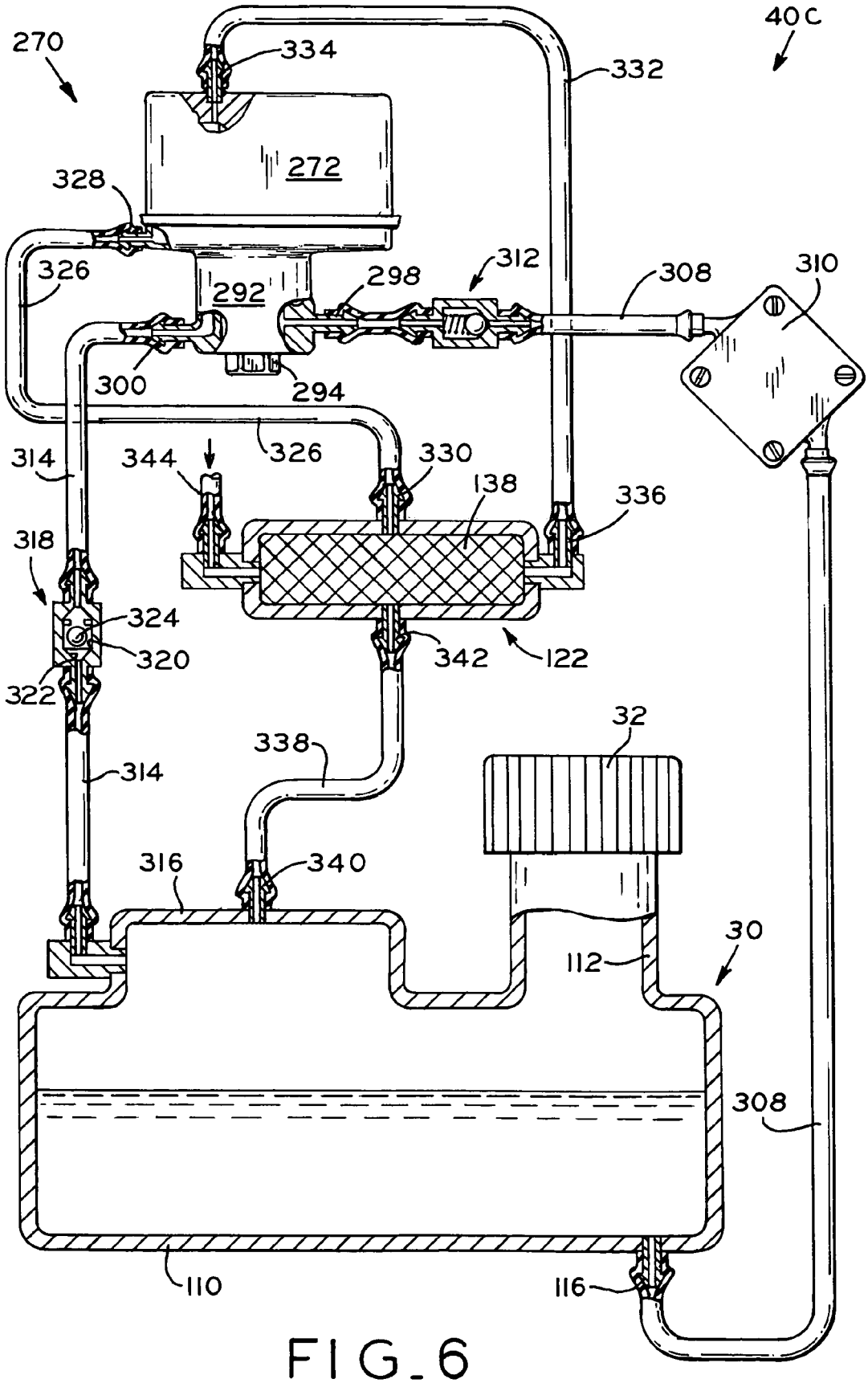
FIG. 6 is a schematic representation of another embodiment of an evaporative emissions control system including a weir-type carburetor.
Figure 7:
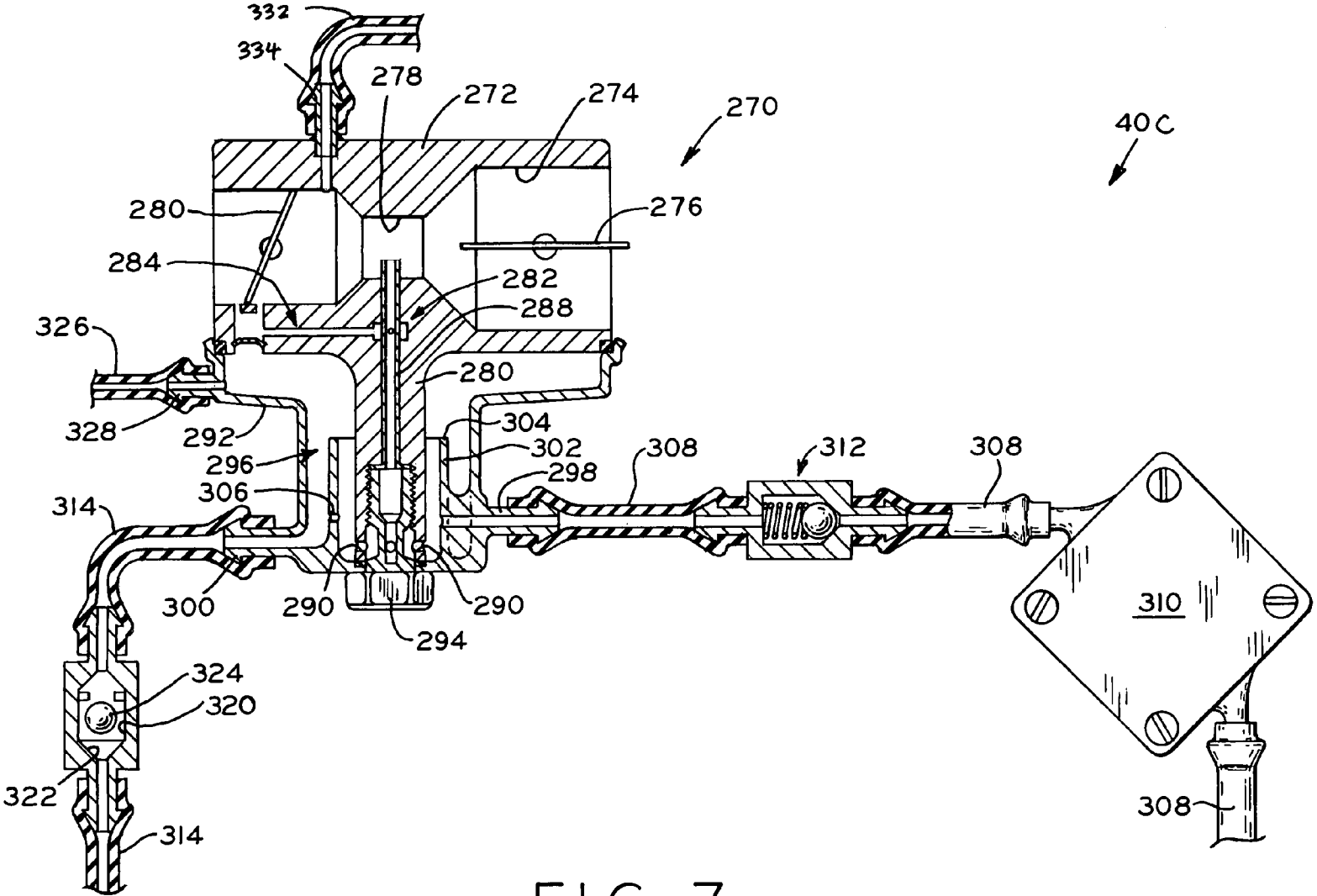
FIG. 7 is a fragmentary, partial sectional view of a portion of the emissions control system of FIG. 6, showing details of the weir-type carburetor.

Engine 28 includes fuel tank 30 storing liquid fuel, with the fill inlet of fuel tank 30 closed by fuel tank cap 32. Generally, as discussed further below, fuel tank 30 supplies liquid fuel to the carburetor 42, 170, or 270 of engine 28, discussed below, which mixes the fuel with intake air to provide a fuel/air combustion mixture for engine 28. The carburetor of engine 28 may be a fuel bowl-type carburetor 42 (FIGS. 2A, 2B, 5A and 5B), a diaphragm carburetor 170 (FIGS. 4A and 4B), or a weir-type carburetor 270 (FIGS. 6 and 7).

Also, handle 26 of lawnmower 20 includes a bail assembly 34 which is actuated by a user before or contemporaneously with startup of engine 28. Typically, bail assembly 34 controls the ignition system of engine 28, and is also connected to a flywheel brake (not shown) via mechanical linkage including cable 36. When actuated by an operator, bail assembly 34 enables the ignition system of engine 28 and releases the flywheel brake to allow running of engine 28. Upon release of bail assembly 34 by the operator, the ignition system is grounded, and the flywheel brake is automatically engaged to quickly stop running of engine 28.

Figure 2A:
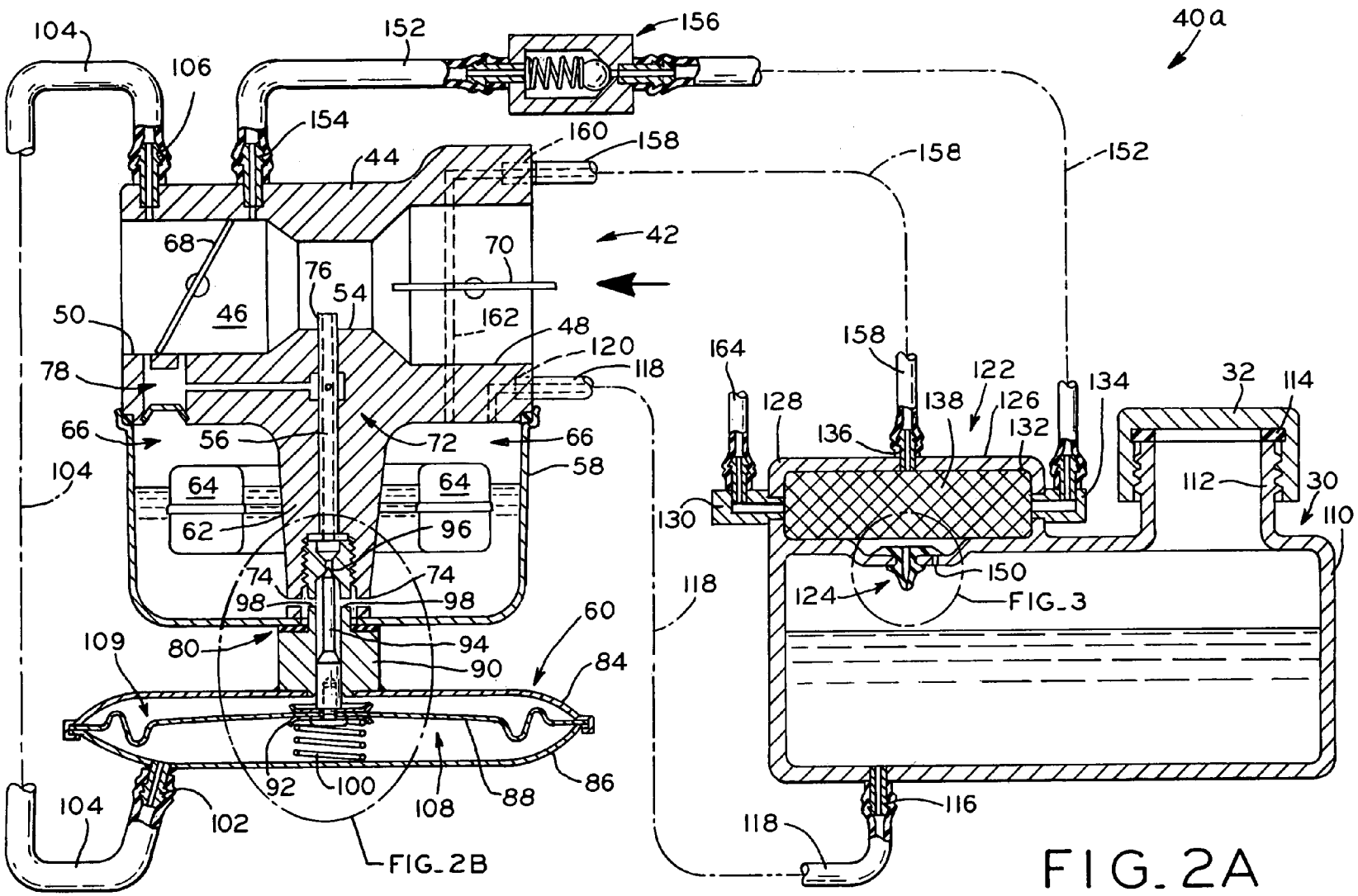
FIG. 2A is a schematic representation of a first embodiment of the evaporative emissions control system, including a fuel bowl-type carburetor, with the fuel circuit shutoff valve of the carburetor in a first or closed position.

Referring to FIG. 2A, an evaporative emissions control system 40*a* in accordance with a first embodiment of the present invention is shown, which includes a float bowl-type carburetor 42. Carburetor 42 generally includes carburetor body 44 having an air intake passage or throat 46 with inlet end 48 connected to an air filter (not shown), and outlet end 50 connected to the intake manifold 52 (FIG. 1) of engine 28. Throat 46 includes a constricted portion or venturi 54 proximate the nozzle of main fuel jet 56 through which liquid fuel is drawn from fuel bowl 58 of carburetor 42 into throat 46 for mixing with intake air in a known manner during running of engine 28. Fuel bowl 58 is connected to carburetor body 44 by valve housing 60 attached to stem portion 62 of carburetor 42 in the manner described below. Fuel bowl 58 contains a volume of liquid fuel therein, and includes an inlet valve (not shown) actuated by float 64 for metering liquid fuel into fuel bowl 58 in a known manner from fuel tank 30 via a gravity feed or a pump feed, for example. Air space or head space 66 of fuel bowl 58 is disposed above the liquid fuel therein.

Throttle valve plate 68 is disposed within throat 46 of carburetor 42, and is rotatable to vary the amount of air/fuel mixture which is supplied to engine 28, and therefore to in turn vary the running speed of engine 28 in a known manner. Throttle valve plate 68 is controlled by an operator of engine 28 and/or by a governor (not shown) of engine 28 through a suitable linkage arrangement (not shown), for example. Choke valve plate 70 is also disposed within throat 46 of carburetor 42 upstream of throttle valve plate 68, and is controlled by the operator via mechanical linkage, for example, to rotate between a substantially closed position to aid in engine starting and an open position during engine running.

Fuel circuit 72 of carburetor 42 fluidly communicates fuel bowl 58 to supply fuel to throat 46 during running of engine 28, and includes a pair of fuel ports 74 in stem portion 62 of carburetor 42 which are in fluid communication with fuel bowl 58, as well as a combination main fuel jet and valve seat 96 and nozzle 76 extending into throat 46 of carburetor 42 at venturi 54. Idle fuel circuit 78 extends in fluid communication from main fuel nozzle 76 and opens into throat 46 of carburetor 42 proximate throttle valve plate 68 to provide idling fuel to throat 46 of carburetor 42 when throttle valve plate 68 is in a closed position.

Carburetor 42 additionally includes fuel circuit shutoff valve 80 for blocking the flow of fuel from fuel bowl 58 to fuel circuit 72 upon shutdown of engine 28, as described below. Fuel circuit shutoff valve 80 generally includes valve housing 60 including first housing member 84 and second housing member 84 secured to one another to capture diaphragm 88 therebetween. First housing member 86 includes an insert portion 90 threadingly inserted into stem portion 62 of carburetor 42. Diaphragm 88 includes central plate 92 attached to needle valve member 94, which extends upwardly toward valve seat 96 of insert portion 90. Insert portion 90 further includes a pair of fuel ports 98 in fluid communication with fuel ports 74, and insert portion 90 is in fluid communication with main fuel jet 96 of fuel circuit.

Spring 100 is mounted under compression between second housing member 86 and central plate 92 of diaphragm 88, and normally biases central plate 92, diaphragm 88, and needle valve member 94 into a first or closed position in which the end of needle valve member 94 firmly seats against valve seat 96 to block the flow of fuel from fuel bowl 58 into fuel circuit 72. Second housing member 86 includes fitting 102 to which vacuum line 104 is connected, with the opposite end of vacuum line 104 connected to fitting 106 of carburetor body 44 in airflow communication with throat 46 of carburetor 42 downstream of throttle valve plate 68. In this manner, a vacuum signal generated within throat 46 of carburetor 42 during running of engine 28 is communicated to a vacuum chamber 108 defined between diaphragm 88 and second housing member 86 of valve housing 60. Alternatively, vacuum chamber 108 may be connected to another vacuum source, such as the crankcase of engine 28, to provide a vacuum signal to vacuum chamber 108 upon running of engine 28. Additionally, a priming feature (not shown) of carburetor 42 may include a bulb (not shown) or other mechanism for providing positive pressure to chamber 109 opposite vacuum chamber 108 to thereby open fuel circuit shutoff valve 80 before engine 28 is started to allow flow of an amount of priming fuel into fuel circuit 72 and throat 46 of carburetor 42 from fuel bowl 58 in order to prime carburetor 42.

Fuel tank 30 generally includes fuel tank body 110 and filler neck 112 having external threads. Fuel tank cap 32 includes internal threads for threaded attachment to filler neck 112 to close fuel tank 30. Gasket 114 is disposed within fuel tank cap 32 to provide a fluid tight seal between fuel tank cap 32 and filler neck 112 such that, when fuel tank cap 32 is attached to filler neck 112, air is prevented from entering fuel tank 30 from the atmosphere, and fuel vapors within fuel tank 30 are prevented from escaping fuel tank 30 to the atmosphere. Thus, fuel tank cap 32 is a "non-vented" cap, and differs from known fuel tank caps which include fuel tank venting arrangements. Fuel tank 30 stores a quantity of liquid fuel, which is supplied through fuel outlet 116 of fuel tank 30 and fuel supply line 118 to fuel inlet 120 of fuel bowl 58 of carburetor 42 by a gravity feed when feel tank 30 is disposed above fuel bowl 58. Alternatively, a fuel pump (not shown) may be used to convey liquid fuel from fuel tank 30 to fuel bowl 58 during running of engine 28.

Evaporative emissions control system 40*a* additionally includes a fuel vapor control device, shown herein as a charcoal or carbon canister 122 which is integrally formed with body 110 of fuel tank 30. Combination valve 124 is disposed within fuel tank body 110 and fluidly communicates directly with charcoal canister 122. Although charcoal canister 122 is shown integrated into fuel tank body 110, charcoal canister may be a component separate from fuel tank 30, or alternatively, may be integrated into fuel tank cap 32 or into carburetor 42, for example, as discussed in detail in U.S. patent application Ser. No. 11/035,655, entitled EVAPORATIVE EMISSIONS CONTROL SYSTEM INCLUDING A CHARCOAL CANISTER FOR SMALL INTERNAL COMBUSTION ENGINES, filed on Jan. 14, 2005, assigned to the assignee of the present invention, the disclosure of which are expressly incorporated herein by reference.

Charcoal canister 122 includes an elongated housing 126 having first end 128 with fitting 130, and opposite second end 132 with fitting 134, wherein first and second ends 128 and 132 are oriented along a major dimension of charcoal canister 122. A third fitting 136, as well as combination valve 124, are located near the central portion of charcoal canister 122 about the minor dimension of charcoal canister 122. Charcoal canister 122 includes a fuel absorbent media therein, such as charcoal media 138 for trapping fuel vapors, as described further below. Charcoal media 138 may be in the form of small pellets or activated charcoal or carbon, or other suitable absorbent material, for example, and suitable charcoal canisters and charcoal media are available from many commercial sources, such as Sentec E&E Co., Ltd., of Taiwan and MeadWestvaco Corporation, P.O. Box 14, Covington, Va. 24426. Charcoal media 84 is typically rated by its Normal Butane Capacity ("NBC") in g/ml. A typical NBC rating is 10, but carbon having capacities of up to 15 is commercially available. Housing 126 of charcoal canister 122 has an elongate profile, such that the length of housing 126 is greater than its cross-sectional width. For example, housing 126 may have a length to cross-sectional width aspect ratio of 2, 3, 4, or more for the reasons discussed below and in detail in the above-incorporated U.S. patent application Ser. No. 11/035,655.

Figure 3:
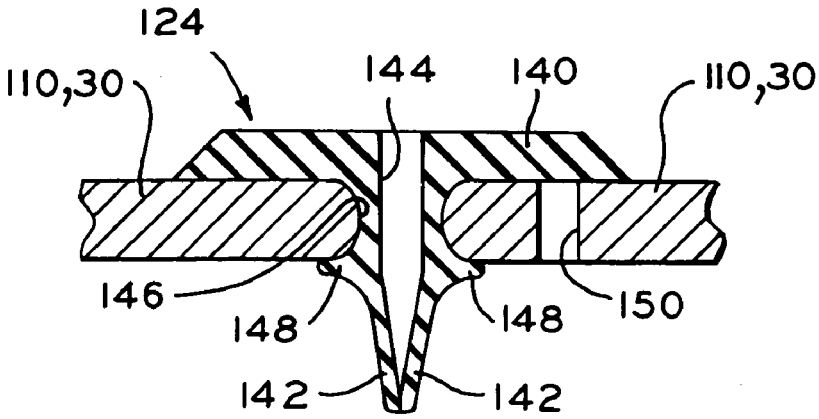
FIG. 3 is a fragmentary, partial sectional view through the body of the fuel tank of the evaporative emissions control system of FIGS. 2A and 4A, showing a combination valve used in the present evaporative emissions control systems.

Combination valve 124 is mounted in fuel tank body 110 and is made of a resilient material such as rubber or flexible plastic. Referring additionally to FIG. 3, combination valve 124 includes a head or flange 140, and a pair of flaps 142 about a main passageway 144 which extends through valve 124. Combination valve 124 may be attached to fuel tank body 110 by pressing valve 124 into opening 146 in fuel tank body 110, with catches 148 of flaps 142 engaging behind fuel tank body 110 with flaps 142 extending into the interior of fuel tank 30. Flaps 142 are "duck bill" type flaps which are normally resiliently biased together to prevent air from passing from fuel tank 30 into charcoal canister 122. However, flaps 142 may flexibly separate from one another to permit air flow from charcoal canister 122 to fuel tank 30 for the reasons discussed below. Flange 140 of combination valve 124 normally overlays and closes hole 150 in fuel tank body 110. However, fuel vapors within fuel tank 30, when built to a sufficient pressure, may resiliently deflect flange 140 of combination valve 124 upwardly such that the fuel vapors may pass through hole 150 into charcoal canister 122.

Referring back to FIG. 2, vacuum line 152 is connected to fitting 154 of carburetor body 44 and to fitting 134 of charcoal canister 122, and optionally includes check valve 156 therein for permitting flow of air only from charcoal canister 122 into throat 46 of carburetor 42. Fuel bowl vent line 158 is connected to third fitting 136 of charcoal canister 122 and to fitting 160 of carburetor body 44 which is in communication through vent passage 162 with the air space 66 above the fuel within fuel bowl 58. Fuel bowl vent line 158 may also include an anti-rollover valve (not shown) therein to prevent liquid fuel from fuel bowl 58 from passing through line 158 into charcoal canister 122 and fouling charcoal media 138 if engine 28 is tipped, for example. Finally, inlet air line 164 is connected to fitting 130 of charcoal canister 122, and is in airflow communication with a suitable source of atmospheric air, such as the air filter (not shown) of engine 28, or with throat 46 of carburetor 42 upstream of choke valve plate 70.

The operation of evaporative emissions control system 40*a* is as follows. When engine 28 is not running, fuel vapors above the liquid fuel in fuel tank 30 are trapped within fuel tank 30 by fuel tank cap 32 and combination valve 124. When the fuel vapors build to a sufficient pressure within fuel tank 30, the fuel vapors deflect flange 140 (FIG. 3) of combination valve 124 and pass through hole 150 in fuel tank body 110 into charcoal canister 122, where the fuel vapors are trapped within charcoal media 138. Similarly, fuel vapors above the liquid fuel within fuel bowl 58 of carburetor 42 may pass through vent passage 162 and fuel bowl vent line 158 into charcoal canister 122, where the fuel vapors are trapped within charcoal media 138. In this manner, evaporative emissions control system 40*a* is closed to the atmosphere when engine 28 is not running, and fuel vapors within the fuel supply system of engine 28, including fuel tank 30 and carburetor 42, are trapped within charcoal canister 122.

Advantageously, fitting 136 of charcoal canister 122 and combination valve 124, through which fuel vapors pass into charcoal media 138, are disposed at the central portion of charcoal canister 122. Thus, fuel vapors from fuel tank 30 and fuel bowl 58 saturate the charcoal media 138 progressively from the center of charcoal canister 122 horizontally outwardly toward the opposite first and second ends 128 and 132 of charcoal canister 122. In this manner, the interior volume of charcoal canister 122 is most effectively utilized for trapping fuel vapors within charcoal media 138.

Additionally, when engine 28 is not running, spring 100 in valve housing 60 of carburetor 42 biases central plate 92, diaphragm 88, and needle valve member 94 upwardly to the first or closed position shown in FIG. 2A, in which needle valve member 94 seats against valve seat 96 to block the flow of fuel from fuel bowl 58 to fuel circuit 72. In this manner, fuel bowl 58 of carburetor is sealed, such that fuel vapors within fuel bowl 58 are prevented from escaping fuel bowl 58 and passing into the atmosphere through fuel circuit 72 and throat 46 of carburetor 42.

When engine 28 is started, the collected fuel vapors trapped within charcoal media 138 are purged from charcoal media 138 and consumed within engine 28. Specifically, passage of air through throat 46 of carburetor 42 generates a vacuum proximate throttle valve plate 68 and fitting 154 of vacuum line 152. This vacuum is communicated through vacuum line 152 to fitting 134 at second end 132 of charcoal canister 122, and atmospheric air is concurrently drawn into first end 128 of charcoal canister 122 through inlet air line 164 to displace the air which is drawn out of charcoal canister 122 through vacuum line 152. In this manner, a flow of atmospheric air is induced axially through charcoal canister 122 from its first end 128 to its second end 132. The airflow through charcoal canister 122 purges the fuel vapors from charcoal media 138, and the fuel vapors are carried with the atmospheric air through line 152 into throat 46 of carburetor 42 for consumption by engine 28.

Also, during running of engine 28, atmospheric make-up air enters charcoal canister 122 during purging of fuel vapors as described above, and a portion of this air may pass through flaps 142 of combination valve 124 into fuel tank 30 as necessary to occupy the expanding air volume within fuel tank 30 which is created by the consumption of liquid fuel from fuel tank 30 during running of engine 28.

Figure 2B:
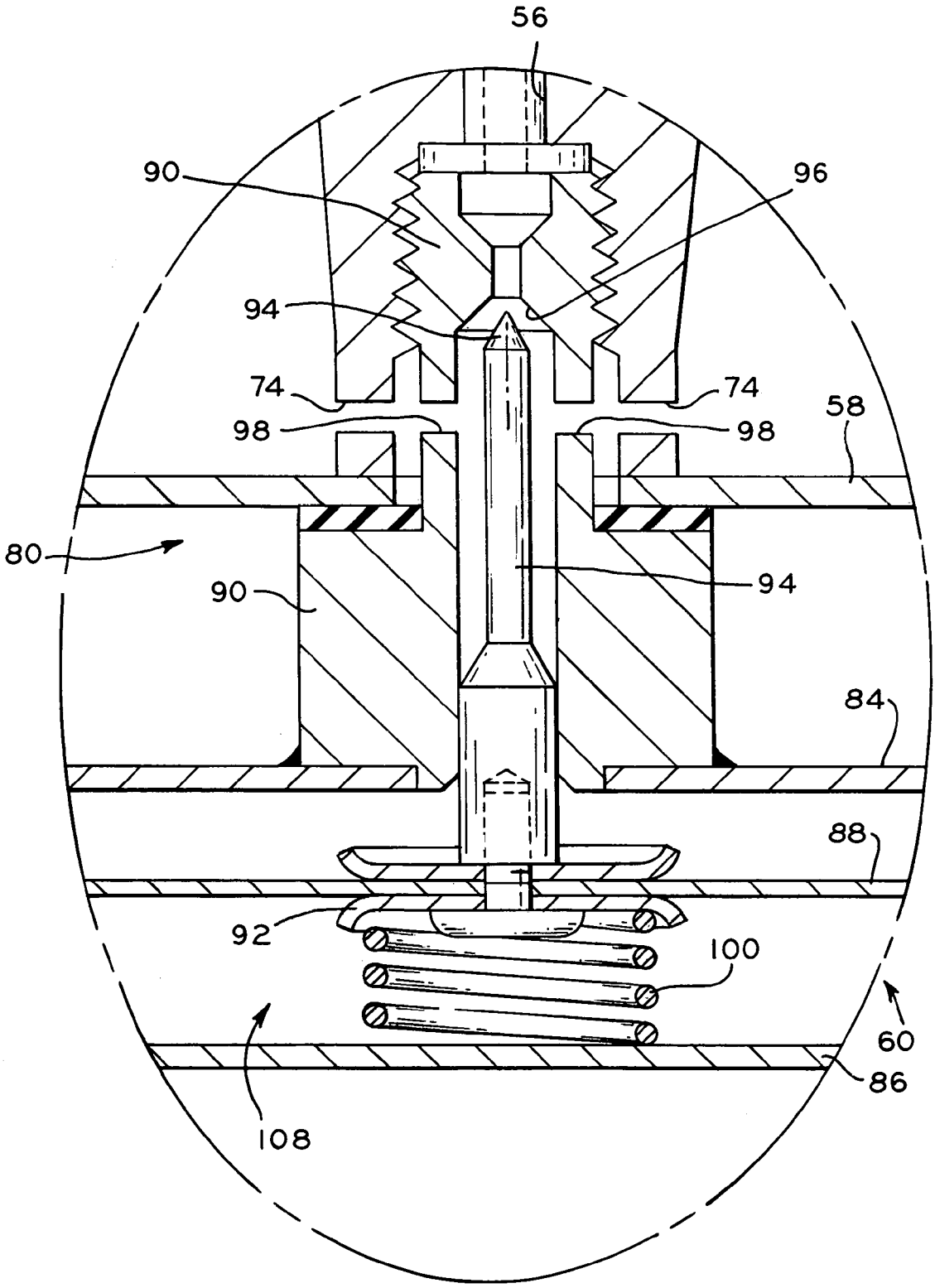
FIG. 2B is a fragmentary view of a portion of the carburetor of the evaporative emissions control system of FIG. 2A, with the fuel circuit shutoff valve of the carburetor in a second or open position.

Concurrently, when engine 28 is started, the vacuum signal from throat 46 of carburetor 42 is communicated through vacuum line 104 to vacuum chamber 108 of valve housing 60 of carburetor 42, thereby forcing diaphragm 88 downwardly against the bias of spring 100 to the position shown in FIG. 2B. Movement of diaphragm 88 responsive to sub-atmospheric pressure in vacuum chamber 108 concurrently moves needle valve member 94 to a second or open position to unseat from valve seat 96. Thus, fuel flow is allowed from fuel bowl 58 through the sets of fuel ports 74 and 98 into fuel circuit 72 of carburetor 42 for supply to throat 46 for mixing with intake air and combustion within engine 28.

Upon shutdown of engine 28, charcoal canister 122 operates as described above to trap fuel vapors from fuel tank 30 and fuel bowl 58 of carburetor 42. Also, upon shutdown of engine 28, throat 46 of carburetor quickly returns to atmospheric pressure, which pressure is communicated to vacuum chamber 108 of valve housing 60. Thereafter, spring 100 biases central plate 92, diaphragm 88, and needle valve member 94 to the first or closed position shown in FIG. 2A as described above to seal fuel and fuel vapors within fuel bowl 58 and prevent the escape of fuel vapors from fuel bowl 58 to the atmosphere. Upon shutdown of engine 28, spring 100 closes fuel circuit shutoff valve 80, and any remaining fuel in fuel circuit 72 results in the loss of only a negligible amount of fuel vapors to the atmosphere.

Figure 4A:
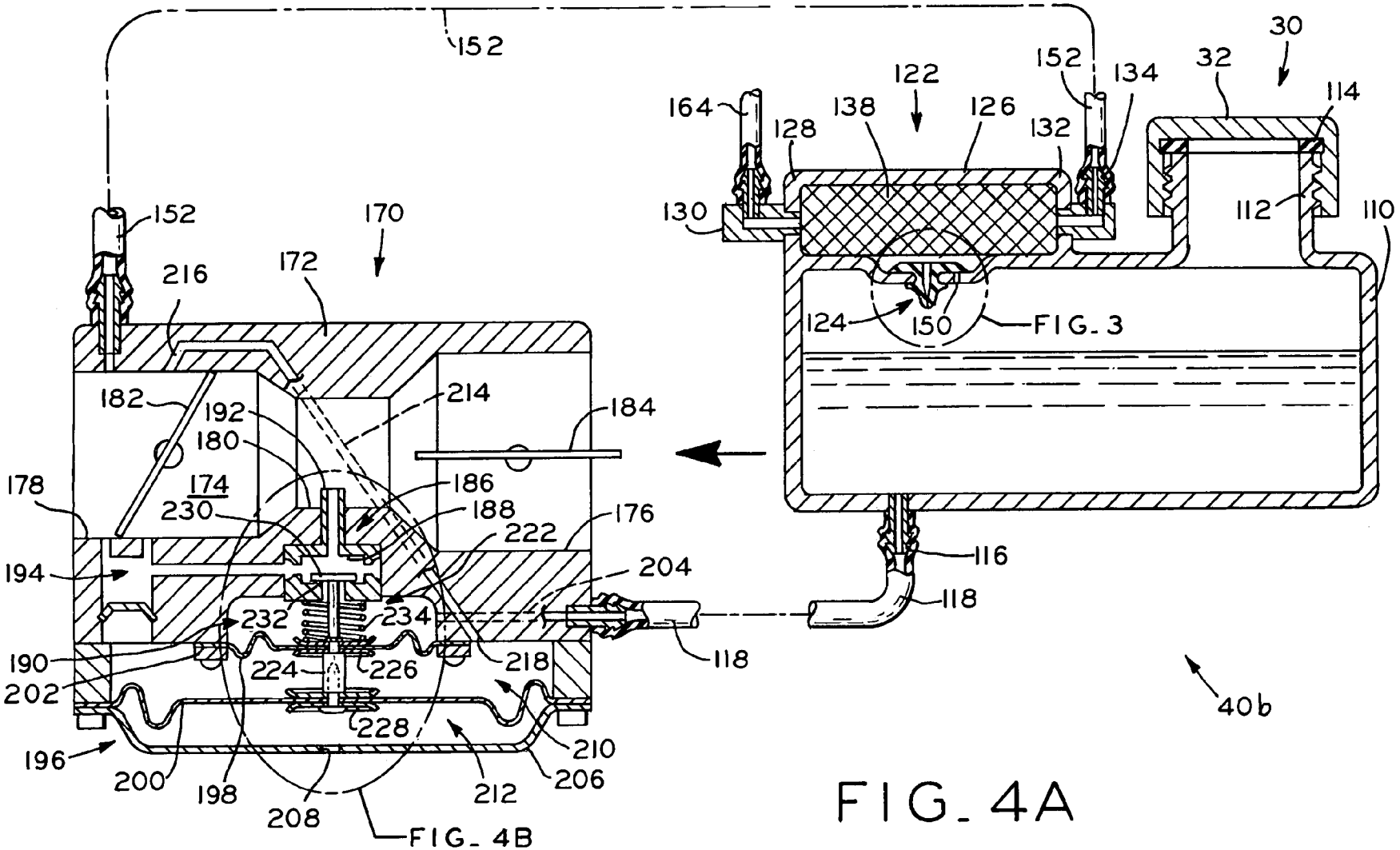
FIG. 4A is a schematic representation of a second embodiment of the evaporative emissions control system, including a diaphragm carburetor, with the fuel circuit shutoff valve of the carburetor in a first or closed position.

Referring to FIG. 4A, evaporative emissions control system 40*b* according to a second embodiment of the present invention is shown. Many of the components of evaporative emissions control system 40*b*, including fuel tank 30 and charcoal canister 122, for example, are identical to those of evaporative emissions control system 40*a* described above, and identical reference numerals have been used to denote identical elements therebetween.

Evaporative emissions control system 40*b* includes diaphragm carburetor 170, which generally includes carburetor body 172 having throat 174 with inlet end 176 connected to an air filter (not shown), and outlet end 178 connected to the intake manifold 52 (FIG. 1) of engine 28. Throat 174 includes a constricted portion or venturi 180 proximate the main fuel jet 192 through which liquid fuel is drawn into throat 174 for mixing with intake air in a known manner during running of engine 28. Carburetor 170 additionally includes throttle valve plate 182 downstream of venturi 180, and choke valve plate 184 upstream of venturi 180.

Carburetor 170 additionally includes fuel circuit 186 for supplying liquid fuel to throat 174 of carburetor 170 during running of engine 28. Fuel circuit 186 generally includes fuel metering chamber 188 in communication with fuel chamber 190, main fuel jet 192 extending upwardly from fuel metering chamber 188 into throat 174, and idle fuel circuit 194 extending from fuel metering chamber 188 and opening into throat 174 at a location proximate throttle valve plate 182.

Carburetor 170 additionally includes diaphragm assembly 196, including first diaphragm 198 and second diaphragm 200, wherein first diaphragm 198 is generally smaller than second diaphragm 200 for the reasons discussed below. First diaphragm 198 is secured to carburetor body 172 via ring plate 202, and fuel chamber 190 is defined between first diaphragm 198 and carburetor body 172. Fuel from fuel supply line 118 passes from fuel tank 30 through fuel passage 204 of carburetor 170 into fuel chamber 190 via gravity feed when fuel tank 30 is disposed above carburetor 170, or alternatively, by a pump feed, for example.

Second diaphragm 200 is secured to carburetor body 172 by cover plate 206, which includes opening 208. Vacuum chamber 210 is defined between second diaphragm 200 and first diaphragm 198 within carburetor 170, and atmospheric chamber 212 is defined between cover plate 206 and second diaphragm 200, with opening 208 communicating atmospheric chamber 212 to the atmosphere. Vacuum passage 214 is formed in carburetor 170, and includes first end 216 in communication with throat 174, and second end 218 in communication with vacuum chamber 210.

Figure 4B:
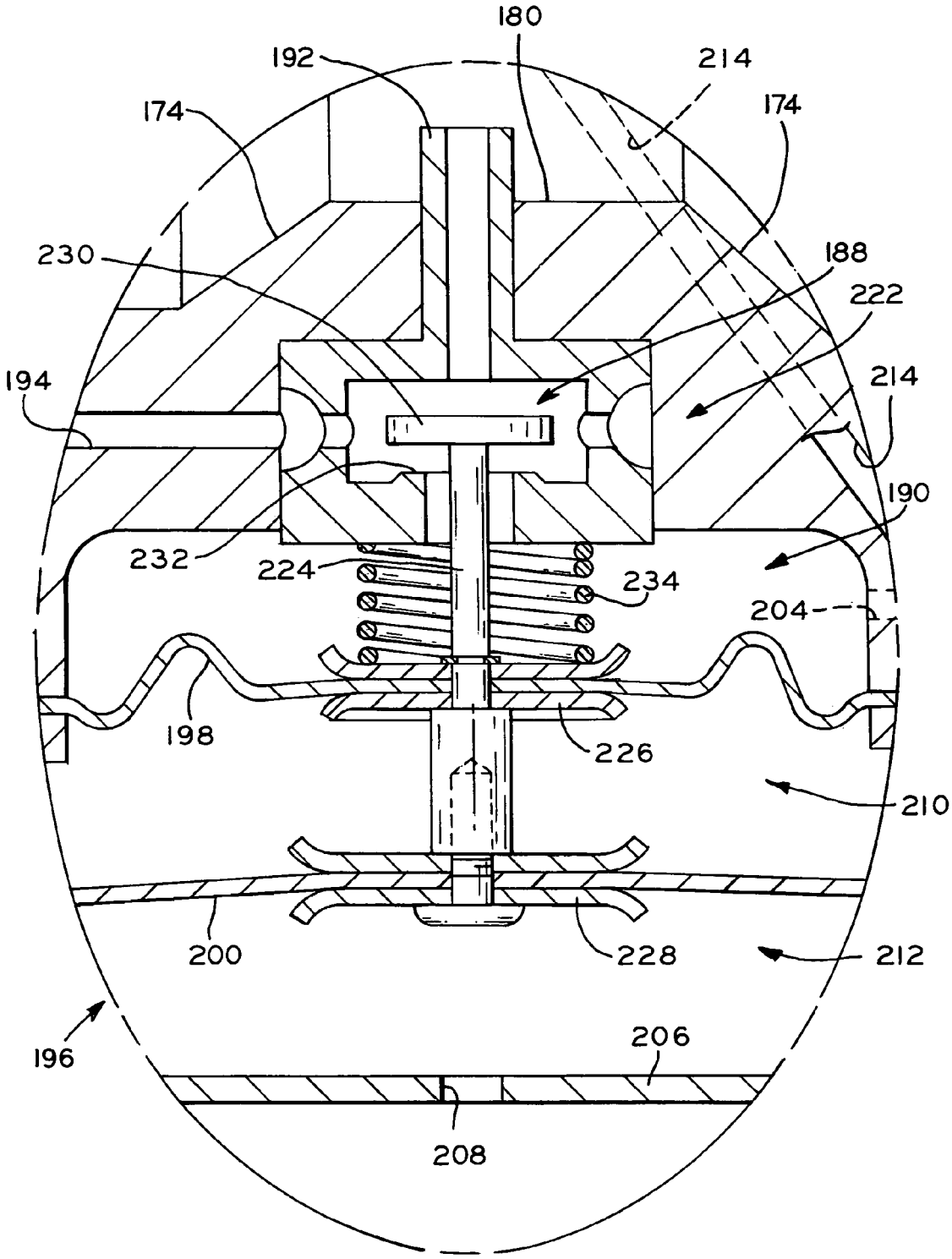
FIG. 4B is a fragmentary view of a portion of the carburetor of the evaporative emissions control system of FIG. 4A, with the fuel circuit shutoff valve of the carburetor in a second or open position.

Referring additionally to FIG. 4B, carburetor 170 additionally includes fuel circuit shutoff valve 222, including valve member 224 connected to central plate 226 of first diaphragm 198 and central plate 228 of second diaphragm 200 such that valve member 224, first diaphragm 198, and second diaphragm 200 are movable together in unison. Valve member 224 includes valve head 230 disposed within fuel metering chamber 188, which is normally biased into engagement with valve seat 232 of fuel metering chamber 188 by the bias force of spring 234, which is mounted under compression between carburetor body 172 and central plate 226 of first diaphragm 198.

The operation of evaporative emissions control system 40*b* is as follows. The functioning of charcoal canister 122 and combination valve 124 is identical to that of evaporative emissions control system 40*a* of the first embodiment, shown in FIGS. 2A and 3, and will not be discussed again in detail. Generally however, charcoal canister 122 traps fuel vapors from fuel tank 30 when engine 28 is not running and, during running of engine 28, a vacuum signal is communicated to second end 132 of charcoal canister 122 through vacuum line 152, with atmospheric air entering first end 128 of charcoal canister 122 through atmospheric air inlet line 164 to purge the fuel vapors from charcoal canister 122 during running of engine 28.

When engine 28 is stopped, spring 234 biases central plate 226 and first diaphragm 198, valve member 224, and central plate 228 and second diaphragm 200 downwardly as shown in FIG. 4A to a first or closed position in which a valve head 230 of valve member 224 is seated against valve seat 232 within fuel metering chamber 188 to block fuel flow from fuel chamber 190 into fuel metering chamber 188. In this manner, fuel circuit 186 of carburetor 170 is sealed from fuel chamber 190 of carburetor 170 when engine 28 is not running to prevent vapors from the liquid fuel within fuel chamber 190 from escaping outwardly of carburetor 170 to the atmosphere.

Upon running of engine 28, a vacuum signal from throat 174 is communicated through vacuum passage 214 to vacuum chamber 210 of carburetor 170. Because the size of second diaphragm 200 is greater than that of first diaphragm 198, atmospheric pressure within atmosphere chamber 212 biases second diaphragm 200 and central plate 228, valve member 224, and central plate 226 and first diaphragm 198 upwardly against the bias of spring 234, thereby lifting valve head 230 of valve member 224 from valve seat 232 to allow fuel flow from fuel chamber 190 into metering chamber 188, and thence through fuel circuit 186 for supply to throat 174 of carburetor 170. Upon engine shutdown, fuel circuit shutoff valve 222 closes in the manner described above to prevent the escape of fuel vapors from fuel chamber 190 of carburetor 170 into the atmosphere. Also, spring 234 closes fuel circuit shutoff valve 222 upon engine shutdown, and any remaining fuel in fuel chamber 188 and fuel circuit 186 results in the loss of only a negligible amount of fuel vapors to the atmosphere.

Figure 5B:
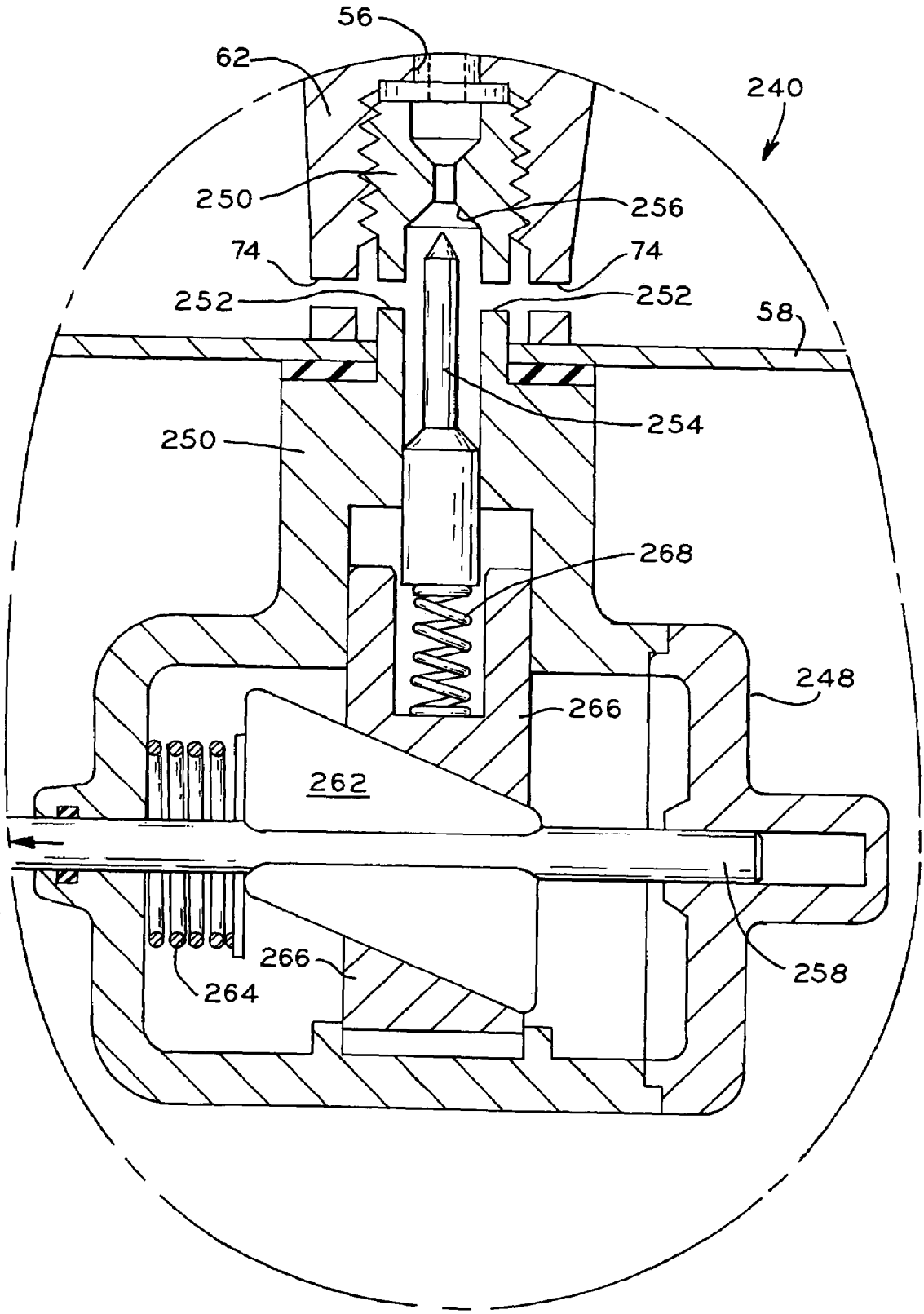
FIG. 5B is a fragmentary view of the carburetor of FIG. 5A, shown with the fuel circuit shutoff valve in a second or open position.

Referring to FIGS. 5A and 5B, a modified version of carburetor 42 is shown which may be used in evaporative emissions control system 40*a*, in which the fuel circuit shutoff valve of carburetor 42 is mechanically actuated by bail assembly 34 of lawnmower 20, or by any other similar mechanism in an implement with which engine 28 is used. Bail assembly 34 includes bail 238 pivotally mounted to handle 26 of lawnmower 20, with bail 238 attached to one end of cable 36. The opposite end of cable 36 is attached to fuel circuit shutoff valve assembly 240 in the manner described below. Cable 36 may be covered by steel tubing 242 which is supported at its opposite ends by a first support 244 on handle 26 and a second support 246 mounted to a suitable portion of engine 28, with cable 36 translatable within tubing 242.

Fuel circuit shutoff valve assembly 240 generally includes valve housing 248 having insert portion 250 threadably inserted into stem portion 62 of carburetor 42, which includes fuel ports 252 aligned with fuel ports 74 of stem portion 62. Valve housing 248 additionally includes needle valve member 254 which is normally biased into engagement with valve seat 256 in the manner described below. Actuator shaft 258 is connected to cable via clevis 260, is slidable with valve housing 248, and includes wedge member 262. Main spring 264 is captured under compression between valve housing 248 and wedge member 262 and, when engine 28 is not running, normally biases actuator shaft 258 toward the right as shown in FIG. 5A, in which wedge member 262 moves valve block 266 to an upper position via the sliding engagement between cooperating angled cam surfaces on wedge member 262 and valve block 266. Valve spring 268 is disposed under compression between a recess in valve block 266 and needle valve member 254, and aids in retaining needle valve member 254 firmly against valve seat 256 when valve assembly 240 is in a first or closed position, as shown in FIG. 5A, to thereby seal fuel bowl 58 of carburetor 42 and block fuel flow from fuel bowl 58 into fuel circuit 72 of carburetor 42.

When bail 238 of bail assembly 34 is pivoted toward handle 26 by an operator before engine 28 is started, cable 36 is translated within tubing 242 to slide actuator shaft 258 and wedge member 262 against the bias of main spring 264 toward the left as shown in FIG. 5B, thereby forcing valve block 266 downwardly. Movement of valve block 266 downwardly exerts a tension load through valve spring 268, which positively forces needle valve member 254 away from valve seat 256 to thereby allow fuel flow from fuel bowl 58 into fuel circuit 72 of carburetor 42. Advantageously, the force exerted upon needle valve member 254 by valve spring 268 forces needle valve member 254 away from valve seat 256 even if needle valve member 254 should become stuck within valve seat 256.

When bail 238 of bail assembly 34 is released upon engine shutdown, main spring 264 moves wedge member 262 and actuator shaft 258 back to the position shown in FIG. 5A, moving valve block 266 upwardly to allow valve spring 268 to bias needle valve member 254 into firm engagement with valve seat 256 to block fuel flow from fuel bowl 58 into fuel circuit 72 of carburetor 42. Upon shutdown of engine 28, main spring 264 and valve spring 268 are operable to close fuel circuit shutoff valve 240 before engine 28 completely stops, thereby aiding in stopping engine 28, and any remaining fuel in fuel circuit 72 which is not rapidly consumed within engine 28 as engine 28 coasts to a stop results in the loss of only a negligible amount of fuel vapors to the atmosphere.

Referring to FIGS. 6 and 7, evaporative emissions control system 40*c* according to a further embodiment of the present invention is shown. Many of the components of evaporative emissions control system 40*c*, including fuel tank 30 and charcoal canister 122, for example, are substantially similar to those of evaporative emissions control systems 40*a* and 40*b* described above, and identical reference numerals have been used to denote substantially similar elements therebetween.

Evaporative emissions control system 40*c* includes a weir-type carburetor 270, shown in FIG. 7, with upper carburetor body 272 having an air intake passage or throat 274 therethrough with choke valve 276, venturi 278, and throttle valve 280, as well as main fuel circuit 282 and idle fuel circuit 284 supplying fuel to throat 274 of carburetor 270 similar to carburetors 42 and 180 described above. The lower portion of carburetor body 272 includes stem portion 286 containing fuel nozzle 288 and fuel ports 290 of main fuel circuit 282. Lower carburetor body 292 is attached to stem portion 286 of upper carburetor body 272 via a nut 294, and fuel chamber 296 is defined generally within lower carburetor body 292 and is enclosed by upper and lower carburetor bodies 272 and 292. Lower carburetor body 292 also includes fuel inlet fitting 298 and fuel outlet fitting 300.

Fuel chamber 296 includes a spill-well or weir 302, which is a cup-shaped portion integrally formed with lower carburetor body 292. Fuel ports 290 and fuel nozzle 288 of main fuel circuit 282 are disposed within weir 302 to draw fuel therefrom, and fuel inlet fitting 298 is in fluid communication with weir 302. Weir 302 additionally includes an open upper end 304 and a bleed port 306 in a lower portion thereof, which is spaced a small distance from the bottom of weir 302 and fluidly communicates the interior of weir 302 with fuel chamber 296.

Referring additionally to FIG. 6, fuel supply line 308 connects fuel tank 30 to fuel inlet fitting 298 of carburetor 270, and fuel pump 310 is disposed within fuel supply line 308 for pumping fuel from fuel tank 30 to weir 302 and fuel chamber 296 of carburetor 270. Fuel pump 310 may be a diaphragm-type fuel pump actuated by pulses from the crankcase of engine 28 or alternatively, may be a mechanical diaphragm, gerotor or vane-type pump which is directly driven from engine 28, for example. Fuel supply line 308 also includes an optional check valve 312, shown herein as a ball-and-spring type check valve, for allowing fuel to pass from fuel pump 310 to weir 302 and fuel chamber 296 of carburetor 270, yet preventing reverse flow of fuel or fuel vapors back to fuel tank 30.

Fuel return line 314 is connected between fuel outlet fitting 300 of carburetor 270 and a vapor dome 316 of fuel tank 30, which is formed as a projection in the upper wall of fuel tank 30 in which fuel vapors collect. Fuel return line 314 includes a buoyant ball-type check valve 318 including chamber 320, valve seat 322, and ball 324. When fuel pump 310 is running, ball 324 is buoyant and freely movable within chamber 320, allowing liquid fuel to pass from carburetor 270 to fuel tank 30. When pump 310 is not running and fuel flow through fuel return line 314 gradually ceases as described below, ball 324 eventually seats by gravity against valve seat 322 to prevent the passage of fuel vapors from fuel tank 30 to fuel chamber 296 of carburetor 270.

Vent line 326 is connected between a vent fitting 328 connected to carburetor 270 at the upper portion of fuel chamber 296 above the liquid fuel therewithin, and fitting 330 of charcoal canister 122. Vacuum line 332 is connected between fitting 334 at throat 274 of carburetor 270 and fitting 336 of charcoal canister 122. Vapor line 338 is connected between fitting 340 of vapor dome 316 of fuel tank 30 and fitting 342 of charcoal canister 122. Vent line 326 and vapor line 338 may each include an anti-rollover valve (not shown) therein to prevent liquid fuel from fuel chamber 296 of carburetor 270 and fuel tank 30 from passing through lines 326 and 338, respectively, into charcoal canister 122 and fouling charcoal media 138 if engine 28 is tipped, for example. Additionally, atmospheric air may enter charcoal canister 122 through atmospheric inlet line 344 which is in fluid communication with a suitable source of atmospheric air.

In operation, fuel pump 310 is actuated upon starting of engine 28 to pump fuel from fuel tank 30 through fuel supply line 308 and check valve 312 into weir 302 of carburetor 270. A portion of the fuel within weir 302 is drawn upwardly through main fuel circuit 282 into throat 274 of carburetor 270 for consumption by engine 28; however, most of the fuel within weir 302 overflows over the open upper end 304 of weir 302 into fuel chamber 296 of carburetor 270. The overflow fuel within fuel chamber 296 flows through fuel return line 314 by gravity through check valve 318, returning to fuel tank 30. Alternatively, a second fuel pump (not shown) may be used to return fuel from fuel chamber 296 to fuel tank 30. In this manner, fuel pump 310 circulates an excess amount of fuel than that which is needed by engine 28 from fuel tank 30 to carburetor 270 and thence from carburetor back to fuel tank 30.

Upon engine shutdown, fuel pump 310 is deactivated, and check valve 312 in fuel supply line 308 closes as described above. Fuel within weir 302 is no longer drawn upwardly through main fuel circuit 282 into carburetor throat 274, and the fuel within fuel chamber 296 returns through fuel return line 314 to fuel tank 30. Concurrently, most of the fuel within weir 302 gradually drains through bleed port 306 and also returns through fuel return line 314 to fuel tank 30. However, a small amount of fuel remains within weir 302 beneath bleed port 306 to provide fuel for a re-start of engine 28. Bleed port 306 may be sized such that it takes several minutes for the fuel within weir 302 to drain upon engine shutdown, enabling sufficient fuel to be available within weir 302 for a quick engine re-start. The majority of any fuel vapors present within fuel chamber 296 and weir 302 after engine 28 is shutdown and weir 302 is substantially drained travel through vent line 326 and are trapped within charcoal media 138 of charcoal canister 122. Advantageously, because the amount of liquid fuel remaining within weir 302 upon engine shutdown is minimized, only a very small amount of fuel vapors, if any, escape through main fuel circuit 282 to the atmosphere. For example, weir 302 may contain only from about 1–5 ml of fuel after weir 302 is drained. Optionally, carburetor 270 may be equipped with a priming device (not shown) to allow an operator to substantially fill weir 302 with fuel to aid in cold engine starts. Also, fuel vapors which collect within vapor dome 316 of fuel tank 30 pass through vapor line 338 and are trapped within charcoal media 138 of charcoal canister 122.

Upon a subsequent engine re-start, vacuum produced within throat 274 of carburetor 270 is communicated through vacuum line 332 to charcoal canister 122 to purge the fuel vapors therefrom, with atmospheric make-up air entering charcoal canister 122 via atmospheric inlet line 344, and fuel pump 310 is actuated to supply fuel to carburetor 270 in the manner described above.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a fuel tank containing liquid fuel;

a fuel vapor control device including a housing in fluid communication with an upper portion of said fuel tank, said housing containing fuel vapor absorbent media, whereby fuel vapors from the liquid fuel within said fuel tank are trapped by said absorbent media; and a carburetor, comprising:

a carburetor body having an air intake passage including a venturi portion;

a fuel chamber containing liquid fuel, said fuel chamber in fluid communication with said fuel tank;

a main fuel circuit fluidly communicating said fuel chamber with said venturi portion of said air intake passage;

an idle fuel circuit fluidly communicating said fuel chamber with said air intake passage downstream of said venturi portion; and a fuel circuit shutoff valve disposed upstream of said main and idle fuel circuits, including a valve member movable between a first, closed position in which fuel flow from said fuel chamber to said air intake passage through said main and idle circuits is substantially prevented and a second, open position in which fuel flow from said fuel chamber to said air intake passage through said main and idle fuel circuits is allowed.

2. The engine of claim 1, wherein said fuel chamber of said carburetor is a fuel bowl, said fuel bowl including a fuel inlet valve metering fuel into said fuel bowl from said fuel tank.

3. The engine of claim 2, wherein said housing is in fluid communication with an upper portion of said fuel bowl, whereby fuel vapors from said fuel bowl are trapped by said absorbent media within said housing.

4. The engine of claim 1, wherein said valve member of said fuel circuit shutoff valve is normally disposed in said first, closed position, and is movable to said second, open position responsive to vacuum with said engine.

5. The engine of claim 4, wherein said fuel circuit shutoff valve further comprises a biasing member biasing said valve member toward said first, closed position.

6. The engine of claim 4, wherein said carburetor comprises:

a valve housing including a diaphragm coupled to said valve member;

a vacuum chamber defined between said diaphragm and said housing and in fluid communication with said air intake passage of said carburetor, wherein vacuum generated within said air intake passage upon running of said engine is communicated to said vacuum chamber to move said diaphragm and said valve member to said second, open position.

7. The engine of claim 4, wherein said carburetor comprises:

first and second diaphragms each connected to said valve member of said fuel circuit shutoff valve, said fuel chamber defined between said first diaphragm and said carburetor body;

a vacuum chamber defined within said carburetor body between said first and second diaphragms, said vacuum chamber in fluid communication with said air intake passage, said first and second diaphragms and said valve member together movable responsive to vacuum within said vacuum chamber between a first position corresponding to engine shutdown in which said vacuum chamber is at atmospheric pressure and said valve member blocks fuel flow from said fuel chamber to said fuel circuit, and a second position corresponding to running of the engine in which said vacuum chamber is at sub-atmospheric pressure said valve member allows fuel flow from said fuel chamber to said fuel circuit.

8. The engine of claim 4, wherein said air intake passage further includes a throttle valve downstream of said venturi portion, and said fuel circuit shutoff valve is movable to said second, open position responsive to a vacuum signal from the air intake passage downstream of said throttle valve.

9. An internal combustion engine, comprising:

a fuel tank containing liquid fuel;

a fuel vapor control device including a housing in fluid communication with an upper portion of said fuel tank, said housing containing fuel vapor absorbent media, whereby fuel vapors from the liquid fuel within said fuel tank are trapped by said absorbent media; and a carburetor, comprising:

a carburetor body having an air intake passage;

a fuel chamber containing liquid fuel, said fuel chamber in fluid communication with said fuel tank;

a fuel circuit fluidly communicating said fuel chamber with said air intake passage, and a fuel circuit shutoff valve associated with said fuel circuit, including a valve member movable between a first, closed position in which fuel flow from said fuel chamber to said air intake passage is substantially prevented and a second, open position in which fuel flow from said fuel chamber to said air intake passage is allowed, said fuel circuit shutoff valve further comprising:

an operator-controlled member; and mechanical linkage connecting said operator-controlled member to said fuel circuit shutoff valve, whereby said fuel circuit shutoff valve is manually controlled.

10. An internal combustion engine, comprising:

a fuel tank containing liquid fuel; and a carburetor, comprising:

a carburetor body having an air intake passage therethrough, said air intake passage including a venturi portion;

a fuel bowl disposed beneath said carburetor body, said fuel bowl in fluid communication with said fuel tank;

a main fuel circuit fluidly communicating said fuel bowl with said venturi portion of said air intake passage;

an idle fuel circuit fluidly communicating said fuel chamber with said air intake passage downstream of said venturi portion; and a vacuum-actuated fuel circuit shutoff valve disposed upstream of said main and idle fuel circuits and including a vacuum chamber in fluid communication with said air intake passage, a diaphragm disposed within said vacuum chamber and connected to a valve member, said diaphragm and valve member together movable between a first, closed position corresponding to atmospheric pressure in said vacuum chamber in which fuel flow from said fuel chamber to said air intake passage through said main and idle fuel circuits is substantially prevented and a second, open position corresponding to sub-atmospheric pressure in said vacuum chamber in which fuel flow from said fuel chamber to said air intake passage through said main and idle fuel circuits is allowed.

11. The internal combustion engine of claim 10, further comprising a fuel vapor control device including a housing in fluid communication with an upper portion of said fuel tank, said housing containing fuel vapor absorbent media, whereby fuel vapors from the liquid fuel within said fuel tank are trapped by said absorbent media.

12. The internal combustion engine of claim 10, further comprising a fuel vapor control device including a housing in fluid communication with an upper portion of said fuel bowl, said housing containing fuel vapor absorbent media, whereby fuel vapors from the liquid fuel within said fuel bowl are trapped by said absorbent media.

13. The internal combustion engine of claim 10, wherein said air intake passage further includes a throttle valve downstream of said venturi portion, and said fuel circuit shutoff valve is movable to said second, open position responsive to a vacuum signal from the air intake passage downstream of said throttle valve.

14. An internal combustion engine, comprising:

a fuel tank containing liquid fuel; and a carburetor, comprising:

a carburetor body having an air intake passage therethrough;

first and second diaphragms;

a fuel chamber defined between said first diaphragm and said carburetor body, said fuel chamber in fluid communication with said fuel tank;

a fuel circuit fluidly communicating said fuel chamber with said air intake passage;

a vacuum chamber defined within said carburetor body between said first and second diaphragms, said vacuum chamber in airflow communication with said air intake passage; and a fuel circuit shutoff valve including a valve member connecting said first and second diaphragms, said first and second diaphragms together movable with said valve member responsive to vacuum within said vacuum chamber between a first position corresponding to atmospheric pressure in said vacuum chamber, in which said valve member closes said fuel circuit, and a second position corresponding to sub-atmospheric pressure within said vacuum chamber, in which said valve member opens said fuel circuit.

15. The internal combustion engine of claim 14, further comprising a fuel vapor control device including a housing in fluid communication with an upper portion of said fuel tank, said housing containing fuel vapor absorbent media, whereby fuel vapors from the liquid fuel within said fuel tank are trapped by said absorbent media.

16. An internal combustion engine, comprising:

a fuel tank containing liquid fuel;

a fuel vapor control device including a housing in fluid communication with an upper portion of said fuel tank, said housing containing fuel vapor absorbent media, whereby fuel vapors from the liquid fuel within said fuel tank are trapped by said absorbent media; and a carburetor, comprising:

a carburetor body having an air intake passage;

a fuel chamber having a fuel inlet and a fuel outlet each in fluid communication with said fuel tank;

a fuel circuit fluidly communicating said fuel chamber with said air intake passage; and a weir disposed within said fuel chamber, said fuel circuit and said fuel inlet each in fluid communication with said weir; and a fuel pump driven from said engine, said fuel pump circulating fuel from said fuel tank to said chamber and thence from said chamber to said fuel tank.

17. The engine of claim 16, wherein said weir further comprises an open upper end in fluid communication with said fuel chamber.

18. The engine of claim 16, wherein said weir further comprises a bleed hole in a lower portion thereof, said bleed hole in fluid communication with said fuel chamber.

19. The engine of claim 16, further comprising at least one of:

a fuel inlet check valve disposed between said fuel pump and said fuel inlet; and a fuel outlet check valve disposed between said fuel outlet and said fuel tank.

20. The engine of claim 16, wherein said housing is in fluid communication with an upper portion of said fuel chamber, whereby fuel vapors from said fuel chamber are trapped by said absorbent media within said housing.

* * * * *